US007616923B2

(12) United States Patent
Hatayama et al.

(10) Patent No.: US 7,616,923 B2
(45) Date of Patent: Nov. 10, 2009

(54) POWER GUIDING DEVICE AND IMAGE FORMING APPARATUS HAVING POWER GUIDING DEVICE

(75) Inventors: Kohji Hatayama, Osaka (JP); Tomofumi Inoue, Osaka (JP); Takeshi Sakashita, Osaka (JP); Yuuji Meguro, Ibaraki (JP); Takeru Muramatsu, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 274 days.

(21) Appl. No.: 11/832,427

(22) Filed: Aug. 1, 2007

(65) Prior Publication Data

US 2008/0050158 A1 Feb. 28, 2008

(30) Foreign Application Priority Data

Aug. 23, 2006 (JP) ..... 2006-226622

(51) Int. Cl.
*G03G 15/01* (2006.01)

(52) U.S. Cl. ..... 399/358; 399/359

(58) Field of Classification Search ..... 399/111, 399/119, 358–360
See application file for complete search history.

(56) References Cited

U.S. PATENT DOCUMENTS 4,941,022 A * 7/1990 Ohmura et al. ..... 399/358
6,782,235 B2 * 8/2004 Serizawa et al. ..... 399/360

FOREIGN PATENT DOCUMENTS

JP 7-210048 8/1995
JP 2005-70449 3/2005
JP 2005-309472 11/2005

OTHER PUBLICATIONS

U.S. Appl. No. 12/125,653, filed May 22, 2008, Inoue, et al.

* cited by examiner

*Primary Examiner*—Hoang Ngo
(74) *Attorney, Agent, or Firm*—Oblon, Spivak, McClelland, Maier & Neustadt, L.L.P.

(57) ABSTRACT

A shutter is rotatably supported by a first powder guiding member. When the first powder guiding member and a second powder guiding member occupy powder guiding positions, the shutter takes an open position. At this moment, a rear end of an upper surface of an open/close plate of the shutter is positioned on an inner side of an upper opening of the second powder guiding member.

12 Claims, 7 Drawing Sheets

POWER GUIDING DEVICE AND IMAGE FORMING APPARATUS HAVING POWER GUIDING DEVICE

CROSS-REFERENCE TO RELATED APPLICATIONS

The present application claims priority to and incorporates by reference the entire contents of Japanese priority document, 2006-226622 filed in Japan on Aug. 23, 2006.

BACKGROUND OF THE INVENTION

1. Field of the Invention

The present invention relates to a powder guiding device having a first powder guiding member and a second powder guiding member, the first powder guiding member and the second powder guiding member being disposed so as to be able to be separated from each other through a relative movement in an approximately horizontal direction from a powder guiding position where a lower opening of the first powder guiding member matches with an upper opening of the second powder guiding member to allow powder to be guided and then again to be able to make a relative movement to the powder guiding position, the device including a shutter that occupies a close position allowing the lower opening of the first powder guiding member to be closed when the first powder guiding member and the second powder guiding member are separated from each other and occupies an open position allowing the lower opening of the first powder guiding member to be opened when the first powder guiding member and the second powder guiding member occupy the powder guiding position. The present invention also relates to an image forming apparatus having such a powder guiding device.

2. Description of the Related Art

The powder guiding device of the type explained above and the image forming apparatus having such a powder guiding device have been conventionally known (see, for example, Japanese Patent Application Laid-Open No. H7-210048). In the powder guiding device of this type, when the first powder guiding member and the second powder guiding member are separated from each other so that the lower opening of the first powder guiding member is closed by the shutter, the powder attached to an inner wall surface of the first powder guiding member may fall down onto the shutter to be attached thereto. As such, when the shutter having powder attached thereto is moved to the open position, a shock occurring due to the movement may cause the powder attached to the shutter to fly to the outside of the powder guiding device.

SUMMARY OF THE INVENTION

It is an object of the present invention to at least partially solve the problems in the conventional technology.

A powder guiding device according to one aspect of the present invention includes a first powder guiding member and a second powder guiding member capable of being separated from each other through a relative movement in an approximately horizontal direction from a powder guiding position where a lower opening of the first powder guiding member matches with an upper opening of the second powder guiding member to allow powder to be guided and making a relative movement to the powder guiding position; and a shutter that takes a close position allowing the lower opening of the first powder guiding member to be closed when the first powder guiding member and the second powder guiding member are separated from each other and takes an open position allowing the lower opening of the first powder guiding member is opened when the first powder guiding member and the second powder guiding member occupy the powder guiding position. A shape and a position of a rotational pivot of the shutter are set such that the shutter includes a pair of side plates facing each other and an open/close plate coupled to a lower portion of the pair of side plates and is rotatably supported, with an upper portion of the pair of side plates as the rotational pivot, between the close position allowing the open/close plate to close the lower opening of the first powder guiding member and the open position allowing the open/close plate to be retracted from the lower opening of the first powder guiding member, the second powder guiding member is formed of an elastic material, the shutter is formed of a material with a stiffness higher than a material of the second powder guiding member, the second powder guiding member pushes the shutter occupying the close position to bring the shutter to the open position when the first powder guiding member and the second powder guiding member make a relative movement to the powder guiding position, and a rear end of an upper surface of the open/close plate in a shutter-moving direction is positioned inside of the upper opening of the second powder guiding member when the shutter occupies the open position and the first powder guiding member and the second powder guiding member occupy the powder guiding position.

An image forming apparatus according to another aspect of the present invention includes a powder guiding device including a first powder guiding member and a second powder guiding member capable of being separated from each other through a relative movement in an approximately horizontal direction from a powder guiding position where a lower opening of the first powder guiding member matches with an upper opening of the second powder guiding member to allow powder to be guided and making a relative movement to the powder guiding position, and a shutter that takes a close position allowing the lower opening of the first powder guiding member to be closed when the first powder guiding member and the second powder guiding member are separated from each other and takes an open position allowing the lower opening of the first powder guiding member is opened when the first powder guiding member and the second powder guiding member occupy the powder guiding position. A shape and a position of a rotational pivot of the shutter are set such that the shutter includes a pair of side plates facing each other and an open/close plate coupled to a lower portion of the pair of side plates and is rotatably supported, with an upper portion of the pair of side plates as the rotational pivot, between the close position allowing the open/close plate to close the lower opening of the first powder guiding member and the open position allowing the open/close plate to be retracted from the lower opening of the first powder guiding member, the second powder guiding member is formed of an elastic material, the shutter is formed of a material with a stiffness higher than a material of the second powder guiding member, the second powder guiding member pushes the shutter occupying the close position to bring the shutter to the open position when the first, powder guiding member and the second powder guiding member make a relative movement to the powder guiding position, and a rear end of an upper surface of the open/close plate in a shutter-moving direction is positioned inside of the upper opening of the second powder guiding member when the shutter occupies the open position and the first powder guiding member and the second powder guiding member occupy the powder guiding position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
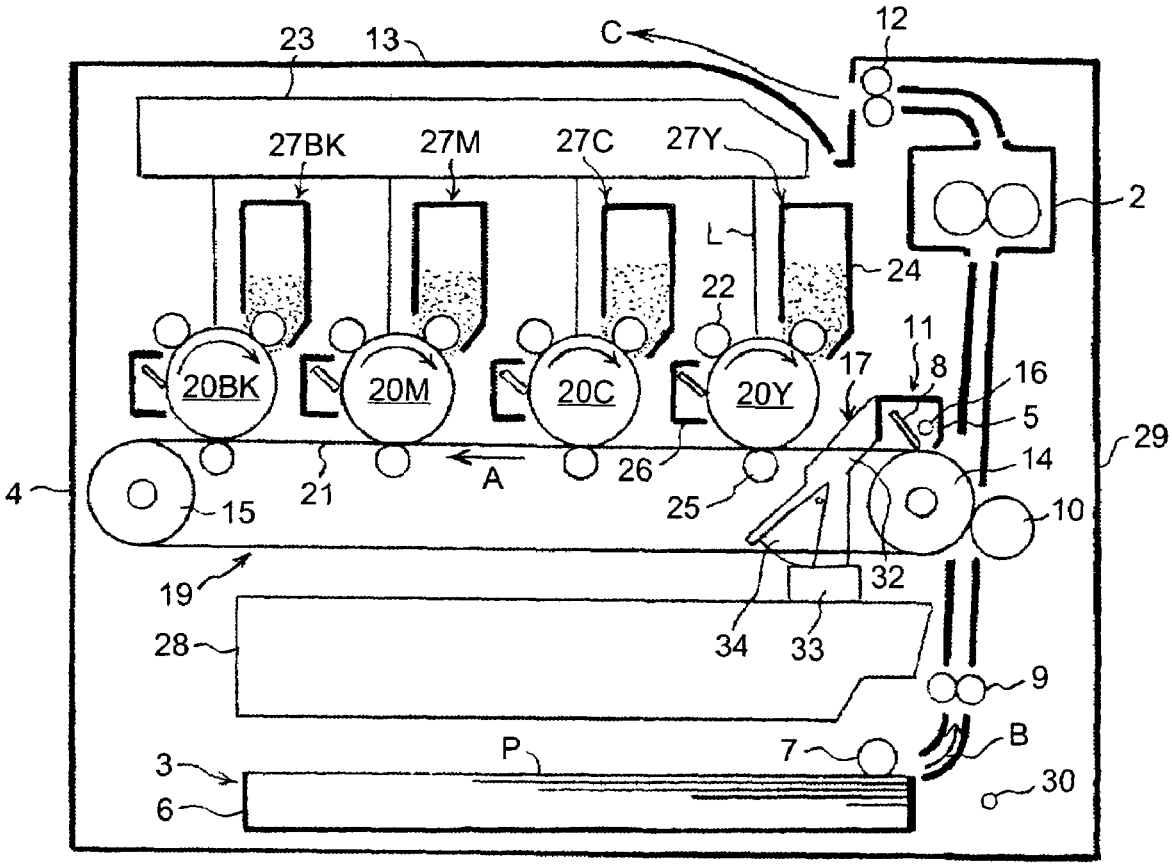
FIG. 1 is a schematic cross-section view of one example of an image forming apparatus.

FIG. 1 is a vertical cross-section view of one example of an image forming apparatus having a powder guiding device. In the image forming apparatus shown in the drawing, an image forming apparatus body 4 has disposed therein first to fourth photosensitive members 20Y, 20C, 20M, and 20BK formed in a drum shape. Facing these photosensitive members, an intermediate transfer member 21 formed of an endless belt wound around a plurality of supporting rollers 14 and 15 is disposed. The first to fourth photosensitive members 20Y to 20BK are driven for rotation in a clockwise direction in FIG. 1. Also, one of the supporting rollers 14 and 15 is driven for rotation, thereby causing the intermediate transfer member 21 to rotate in a direction indicated by an arrow A. At this time, the first photosensitive member 20Y is charged by a charging roller 22 at a predetermined polarity. On the other hand, an optically-modulated laser beam L is emitted from an optical writing unit 23. With that laser beam L, a charging surface of the first photosensitive member 20Y is radiated. With this, an electrostatic latent image is formed on the first photosensitive member 20Y. This electrostatic latent image is visualized as a yellow toner image with a powder-type toner accommodated in a developing device 24. On the other hand, a transfer voltage is applied to a primary transfer roller 25, thereby causing the toner image formed on the photosensitive member 20Y to be subjected to primary transfer onto the intermediate transfer member 21 rotating in the direction indicated by the arrow A. Residual transfer toner attached to the photosensitive member 20Y after toner image transfer is removed by a cleaning device 26. The toner removed by the cleaning device 26 is returned the developing device 24 via a toner returning device not shown for reuse.

In exactly the same manner as above, a cyan toner image, a magenta toner image, and a black toner image are formed on the second to fourth photosensitive members 20C, 20M, and 20BK, respectively. These toner image are sequentially superposed on the intermediate transfer member 21 onto which the yellow toner image has been transferred for primary transfer.

On the other hand, the image forming apparatus body 4 has disposed on its lower portion a paper-feeding device 3. This paper-feeding device 3 has a paper-feeding tray 6 having accommodated therein recording media P formed of, for example, transfer sheets or resin films, and a paper-feeding roller 7 in contact with the uppermost recording media P. With the rotation of the paper-feeding roller 7, an uppermost recording medium P is sent in a direction indicated by an arrow B. With the rotation of paired resist rollers 9, the sent recording medium is fed to a gap between the intermediate transfer member 21 and a secondary transfer roller 10 facing the intermediate transfer member 21 at a predetermined timing. At this time, a transfer voltage is applied to the secondary transfer roller 10, thereby causing the superposed toner image on the intermediate transfer member 21 to be subjected to secondary transfer onto a recording medium. Residual transfer toner attached to the intermediate transfer member 21 after toner image transfer is removed by a belt cleaning device 11. Also, the recording medium onto which the toner image has been transferred passes through a fixing device 2. With the action of heat and pressure, the toner image on the recording medium is fixed to the recording medium. The recording medium passing through the fixing device 2 is delivered by paired paper delivery rollers 12 onto a paper-feeding unit 13 as indicated by an arrow C.

The photosensitive members 20Y, 20C, 20M, and 20BK and their charging rollers 22, the developing devices 24, and the cleaning devices 26 shown in FIG. 1 form removable process cartridges 27Y, 27C, 27M, and 27BK to the image forming apparatus body 4. Also, the supporting rollers 14 and 15 around which the intermediate transfer member 21 is wound are rotatably supported by a frame not shown. The intermediate transfer member 21, the supporting rollers 14 and 15, the frame supporting the rollers, and the belt cleaning device 11 form an intermediate transfer unit 19.

The belt cleaning device 11 has a casing 5 extending in a direction perpendicular to a paper surface of FIG. 1, a cleaning blade 8 fixed to the casing 5, and a toner conveying screw 16 disposed inside the casing 5. The cleaning blade 8 has a tip edge portion in a close contact with the surface of the intermediate transfer member 21, scraping the residual transfer toner attached to that surface for removal. The removed toner is conveyed by the rotation-driven toner conveying screw 16 in a depth direction perpendicular to the paper surface of FIG. 1 for delivery to the outside of the casing 5.

As explained above, the powder-like toner delivered to the outside of the casing 5 is guided by a powder guiding device 17 from a toner entrance of a waste toner container 28 disposed under the intermediate transfer member 21 to the inside of the waste toner container 28, and is then accommodated in that container as waste toner. The powder guiding device 17 will be explained in detail below.

On the right side of the image forming apparatus body 4 shown in FIG. 1, an open/close member 29 is supported with respect to the image forming apparatus body 4 via a pivot pin 30 provided at its lower portion so as to be able to be rotatably open and close. When the user grabs an upper portion of the open/close member 29 by hand and pulls it to the right in FIG. 1, the open/close member 29 rotates around the pivot pin 30 as shown in FIG. 2, thereby opening an opening 31 on the right side of the image forming apparatus body 4.

Figure 2:
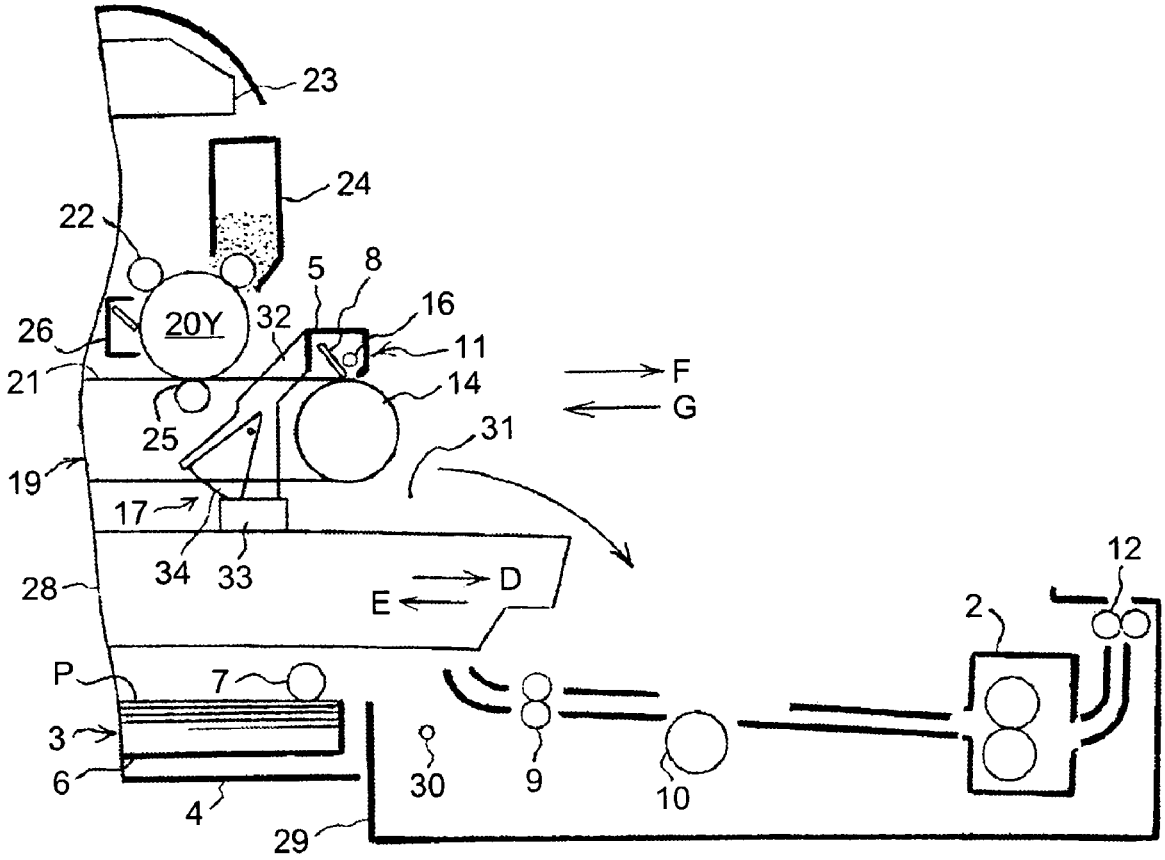
FIG. 2 is a schematic cross-section view of the image forming apparatus when an open/close member is open.

When the waste toner container 28 is full of waste toner and is replaced with a vacant waste toner container, the open/close member 29 is opened as shown in FIG. 2. Through the opening of the opening 31 of the image forming apparatus body 4, the waste toner container 28 is drawn as indicated by an arrow D. At this time, the waste toner container 28 moves in the direction indicated by the arrow D as being guided by a guide rail not shown. Conversely, with the waste toner container 28 being pushed in a direction indicated an arrow E in reverse to the direction indicated by the arrow D, the waste toner container 28 is retracted to a predetermined insertion position in the image forming apparatus body shown in FIG. 1, thereby closing the open/close member 29. In this manner, the waste toner container full of toner can be replaced with a new vacant waste toner container. Also, by opening the open/close member 29, not only the waste toner container 28 but also the process cartridges 27Y, 27C, 27M, and 27BK and the intermediate transfer unit 19 can be drawn to the outside of the image forming apparatus body as indicated by an arrow F, or can be pushed in a direction indicated by an arrow G in reverse to the arrow F to be set inside of the image forming apparatus body.

The powder guiding device 17 shown in FIG. 1 has a first powder guiding member 32 fired to an end on a dept side of the casing 5 in FIG. 1 forming the belt cleaning device 11, a second powder guiding member 33, and a shutter 34. The second powder guiding member 33 is fixed to the waste toner container 28.

Figure 3:
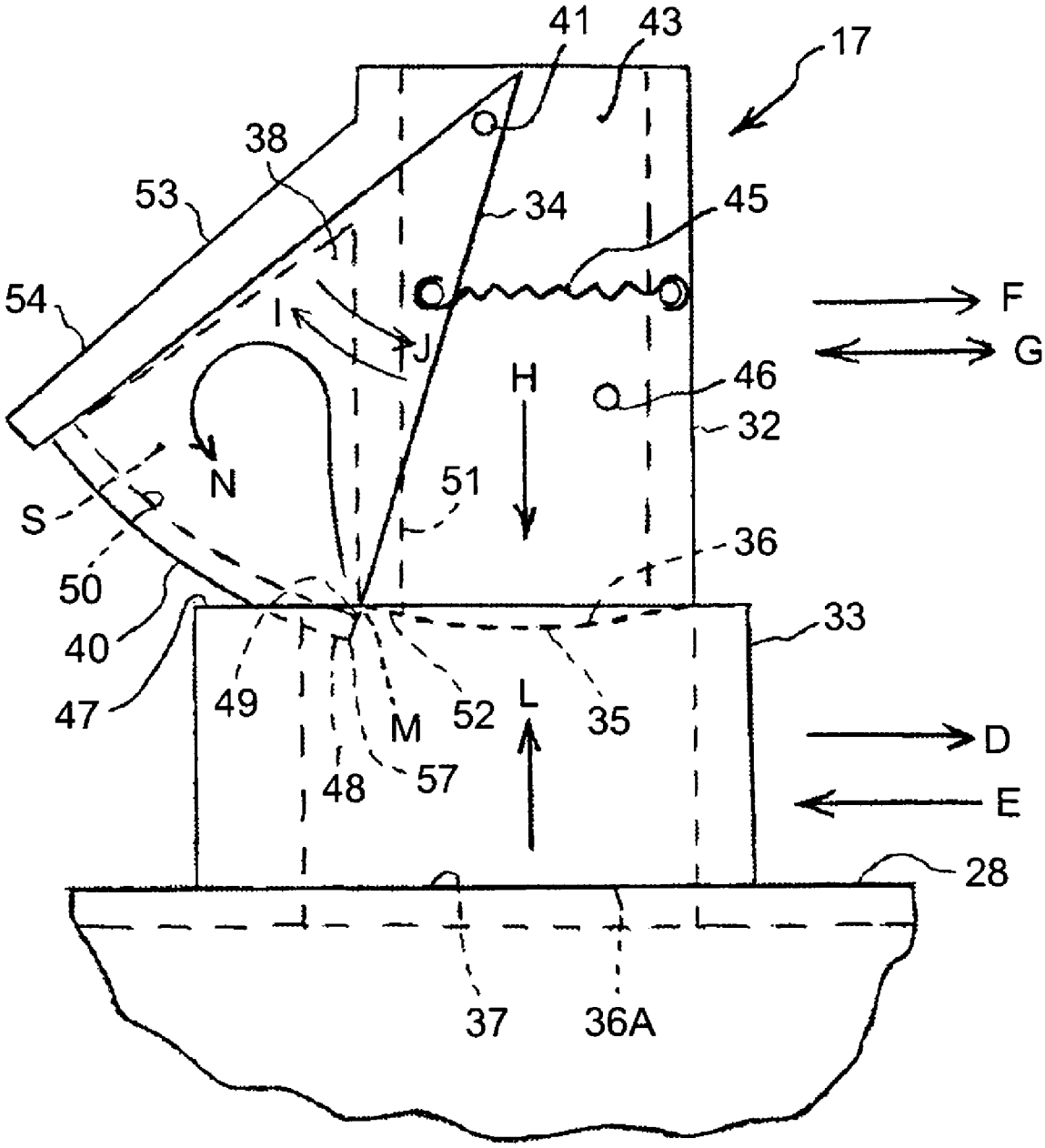
FIG. 3 is a drawing for a brief explanation of a powder guiding device when first and second powder guiding members occupy powder guiding positions.
Figure 4:
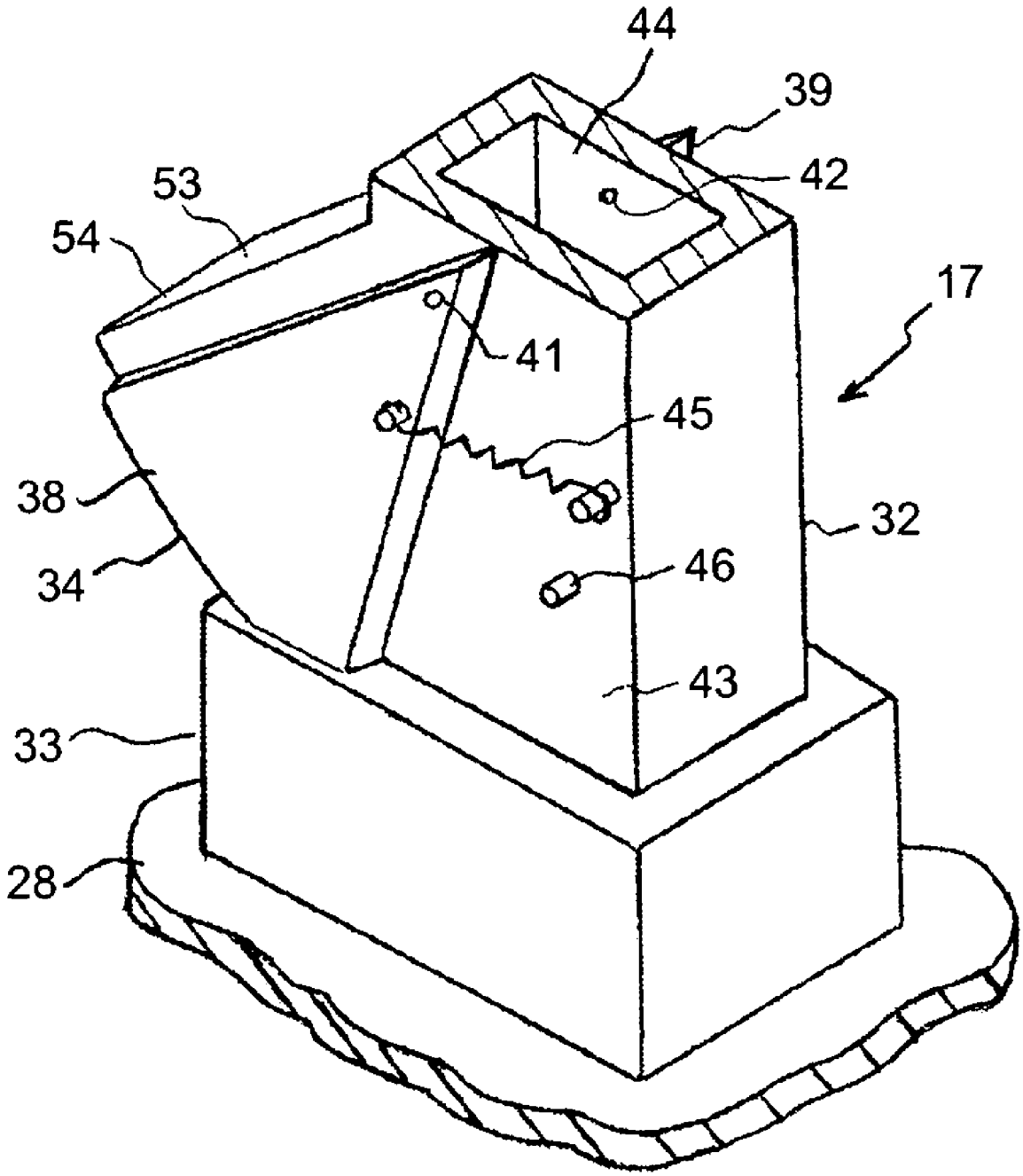
FIG. 4 is an external perspective view of the powder guiding device shown in FIG. 3.
Figure 5:
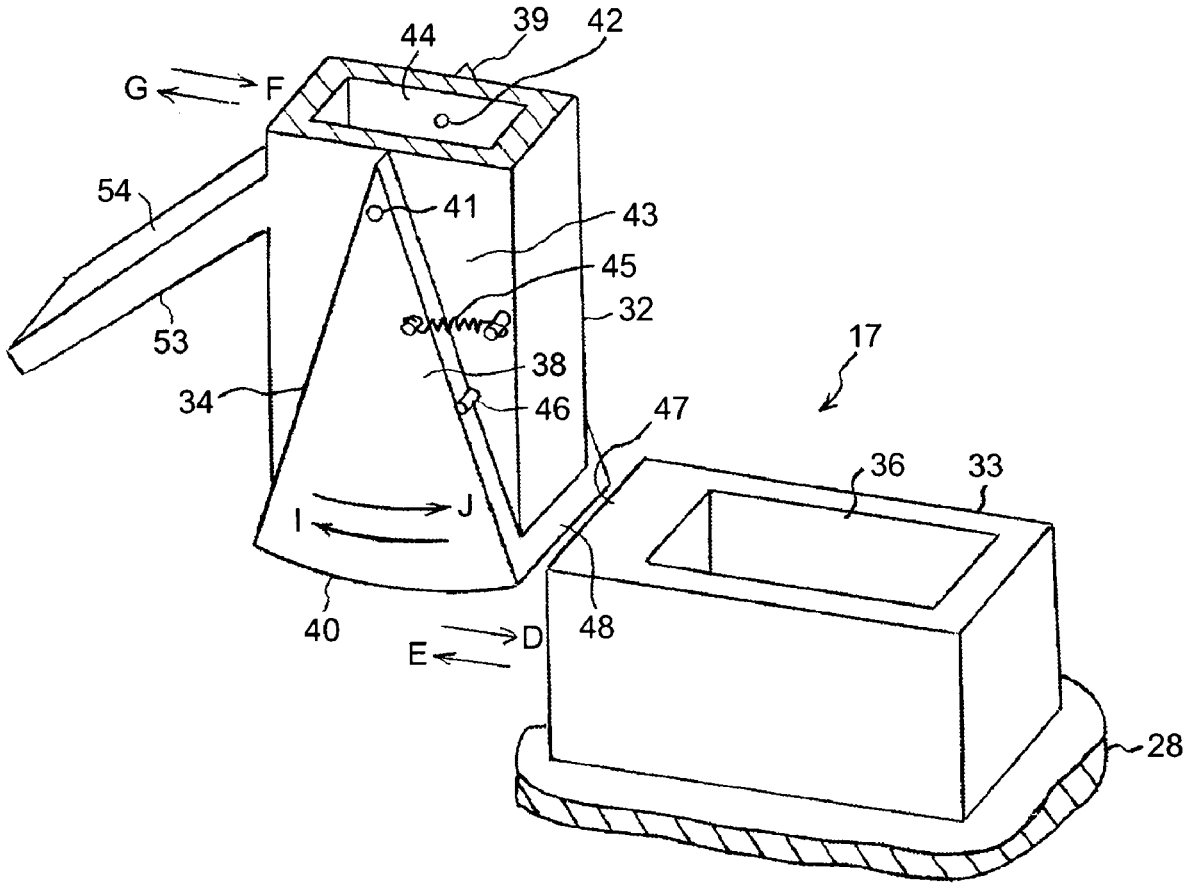
FIG. 5 is a schematic perspective view when the first powder guiding member and the second powder guiding member are separated from each other.

FIGS. 3 to 5 are schematic explanatory drawings of the powder guiding device 17. As shown in FIGS. 3 and 4, the first powder guiding member 32 and the second powder guiding member 33 are each formed of a hollow member with its upper and lower portions being open. In states shown in FIGS. 1, 3, and 4, the first powder guiding member 32 and the second powder guiding member 33 are positioned in a vertically stacked state. With a lower opening 35 of the first powder guiding member 32 matching with an upper opening 36 of the second powder guiding member 33, inner spaces of both of the first powder guiding member 32 and the second powder guiding member 33 communicate with each other. Also, the second powder guiding member 33 is fixed to an upper surface of an upper wall of the waste toner container 28 with a lower opening 36A of the second powder guiding member 33 matching with a toner entrance 37 formed on the upper wall of the waste toner container 28. Also, the shutter 34 is retracted from the lower opening 35 of the first powder guiding member 32 to occupy an open position. Therefore, the lower opening 35 is not closed by the shutter 34. Thus, the inside of the casing 5 of the belt cleaning device 11 in FIG. 1, the inside of the first powder guiding member 32, and the inside of the second powder guiding member 33, and the inside of the waste toner container 28 all communicate. Residual transfer toner, which is one example of powder removed by the belt cleaning device 11 from the intermediate transfer member 21 is delivered from the casing 5 and is then, as indicated by an arrow H in FIG. 3, guided by the first powder guiding member 32 and the second powder guiding member 33 to the inside of the waste toner container 28. In this manner, the position of the first powder guiding member 32 and the second powder guiding member 33 allowing the powder to be guided is a powder guiding position.

On the other hand, as mentioned above, when the open/close member 29 is opened to a position shown in FIG. 2 and the waste toner container 28 is then drawn in an approximately horizontal direction indicated by the arrow D, the second powder guiding member 33 of the powder guiding device 17 also moves in an approximately horizontal direction indicated by the arrow D in FIG. 3. With this, as shown in FIG. 5, the second powder guiding member 33 is separated from the first powder guiding member 32. At this time, the lower opening 35 (FIG. 3) of the first powder guiding member 32 is closed by the shutter 34 as shown in FIG. 5, thereby inhibiting the toner from falling down from the lower opening 35 of the first powder guiding member 32. The position of the shutter 34 at this time is a close position of the shutter 34.

Again, when the waste toner container 28 is pushed together with the second powder guiding member 33 in a direction indicated by the arrow E shown in FIGS. 2 and 5 to be inserted in the image forming apparatus body 4, as shown in FIGS. 1, 3, and 4, the second powder guiding member 33 is again positioned under the first powder guiding member 32, thereby causing the lower opening 35 of the first powder guiding member 32 to match with the upper opening 36 of the second powder guiding member 33. That is, the first powder guiding member 32 and the second powder guiding member 33 occupy the powder guiding position. Also, since the shutter 34 occupies an open position, the residual transfer toner removed by the belt cleaning device 11 from the intermediate transfer member 21 can be conveyed to the waste toner container 28 without problems.

Also, as explained above, by opening the open/close member 29 as shown in FIG. 2, the intermediate transfer unit 19 can be drawn in the direction indicated by the arrow F, and by pushing the intermediate transfer unit 19 in the direction indicated by the arrow G, the intermediate transfer unit 19 can be set inside of the image forming apparatus body 4. When the intermediate transfer unit 19 is inserted and removed, the first powder guiding member 32 fixed to the casing 5 of the belt cleaning device 11 is also inserted and removed in the directions indicated by the arrow G and F, respectively. Therefore, when the intermediate transfer unit 19 is drawn in the direction indicated by the arrow F in FIG. 2, the first powder guiding member 32 of the first and second guiding members 32 and 33 that have occupied the powder guiding position so far in a vertically stacked state as shown in FIGS. 3 and 4 moves in an approximately horizontal direction indicated by the arrow F in FIGS. 2 and 3, thereby causing the first powder guiding member 32 and the second powder guiding member 33 to be separated from each other as shown in FIG. 5. At this time, in practice, the first powder guiding member 32 is positioned on the right side of the second powder guiding member 33 in FIG. 5. Again, when the first powder guiding member 32 and the intermediate transfer unit 19 are pushed in the direction indicated by the arrow G in FIGS. 2 and 5 so that the intermediate transfer unit 19 is set inside of the image forming apparatus body, the first powder guiding member 32 and the second powder guiding member 33 occupy the powder guiding position in a vertically stacked state as shown in FIGS. 1, 3, and 4.

As explained above, the powder guiding device 17 in this example has the first powder guiding member 32 and the second powder guiding member 33, the first powder guiding member 32 and the second powder guiding member 33 being disposed so as to be able to be separated from each other through a relative movement in an approximately horizontal direction from the powder guiding position where the lower opening 35 of the first powder guiding member 32 matches with the upper opening 36 of the second powder guiding member 33 to allow powder to be guided and then again to be able to make a relative movement to the powder guiding position, the device including the shutter 34 that occupies a close position allowing the lower opening 35 of the first powder guiding member 32 to be closed when the first powder guiding member 32 and the second powder guiding member 33 are separated from each other and occupies an open position allowing the lower opening 35 of the first powder guiding member 32 to be opened when the first powder guiding member 32 and the second powder guiding member 33 occupy the powder guiding position. A specific configuration of the powder guiding device 17 is clarified below.

The shutter 34 depicted from FIGS. 3 to 5 has a pair of side plates 38 and 39 facing each other across the first guiding member 32 and an open/close plate 40 in the form of a segment of a circle integrally connected to a lower portion of the pair of side plates 38 and 39. Also, the side plates 38 and 39 have their upper portions rotatably supported via concentric pivot pins 41 and 42 in directions indicated by arrows I and J shown in FIGS. 3 and 5 with respect to wall portions 43 and 44 of the first powder guiding member 32 facing each other. When the shutter 34 occupies the close position shown in FIG. 5, the open/close plate 40 of the shutter 34 closes the lower opening 35 (FIG. 3) of the first powder guiding member 32. Also, when the shutter 34 occupies the open position shown in FIGS. 3 and 4, the open/close plate 40 is retracted from the lower opening 35 of the first powder guiding member 32. That is, with the upper portion of the pair of side plates 38 and 39 as rotation pivots, the shutter 34 is rotatably supported between the close position shown in FIG. 5 where the open/close plate 40 of the shutter 34 closes the lower opening 35 of the first powder guiding member 32 and the open position shown in FIGS. 3 and 4 where the open/close plate 40 is retracted from the lower opening 35 of the first powder guiding member 32. The side plates 38 and 39 of the shutter 34 in this example are each formed in an approximately triangular shape, but can be formed in another shape.

Also, the second powder guiding member 33 is configured of a soft foam, such as sponge, or an elastic material, such as soft rubber. The shutter 34 and the first powder guiding member 32 are configured of a material with a stiffness higher than that of the second powder guiding member 33, such as hard resin or metal.

Furthermore, as shown in FIGS. 3 to 5, a tension spring 45 has its ends stopped at the side wall 43 of the first powder guiding member 32 and the shutter 34. With this, the shutter 34 is pushed for rotation in a direction indicated by an arrow J in FIG. 5. When the first powder guiding member 32 and the second powder guiding member 33 are separated from each other as shown in FIG. 5, the shutter 34 is held at the close position as abutting on a stopper pin 46 protruding from the side wall 43 of the first powder guiding member 32. With this, the lower opening 35 of the first powder guiding member 32 is reliably closed by the open/close plate 40 of the shutter 34.

As explained above, when the first powder guiding member 32 and the second powder guiding member 33 are separated from each other, the lower opening 35 of the first powder guiding member 32 is closed by the open/close plate 40 of the shutter 34. Therefore, even toner attached to the inner wall surface of the first powder guiding member 32 falls down, the toner is received by the open/close plate 40 and does not flay from the lower opening 35 of the first powder guiding member 32. The toner falling down from the inner wall surface of the first powder guiding member 32 is received by an upper surface 50 (FIG. 3) of the open/close plate.

Here, when the waste toner container 28 as well as the second powder guiding member 33 are moved in a direction indicated by an arrow E in FIG. 5 so as to bring the first powder guiding member 32 and the second powder guiding member 33 separated from each other as shown in FIG. 5 to the powder guiding position shown in FIGS. 3 and 4, the second powder guiding member 33 first has its front end 47 in the moving direction abutting on a portion 48 of the shutter 34 that faces the front end, thereby pressing the portion 48. With this, the shutter 34 rotates against the action of the tension spring 45 in a direction indicated by an arrow I. At this time, the powder, that is, toner, attached to the upper surface 50 (FIG. 3) of the open/close plate of the shutter 34 falls down to the inside of the second powder guiding member 33. Also, in the powder guiding device 17 in this example, the upper surface 50 of the open/close plate is configured so as to move closely to a lower end face 52 of a wall portion 51 (FIG. 3) of the first powder guiding member 32. Therefore, the toner attached to the upper surface 50 of the open/close plate of the shutter 34 rotating in the direction indicated by the arrow I is scraped by the lower end face 52 of the wall portion 51 to efficiently fall down to the inside of the second powder guiding member 33.

In the manner as explained above, the shutter 34 reaches and stops at the open position shown in FIG. 3. After that, the second powder guiding member 33 moves for a subtle distance in the direction indicated by the arrow E to reach and stop at a position shown in FIG. 3. Thus, immediately before the second powder guiding member 33 reaches the position shown in FIG. 3, the portion 48 of the shutter 34 that has already reached the open position presses the front end 47 of the second powder guiding member 33 to go over the front end 47 as elastically deforming the front end 47. In this manner, when the shutter 34 rotates in the direction indicated by the arrow J to reach the open position and the first powder guiding member 32 and the second powder guiding member 33 move in the direction indicated by the arrow E to reach the powder guiding position, as shown in FIG. 3, a rear end 49 of the upper surface 50 of the open/close plate in the shutter-moving direction is positioned inside of the upper opening 36 of the second powder guiding member 33. Therefore, even if some toner is still attached to the upper surface 50 of the open/close plate of the shutter 34 reaching the open position, the toner does not fly to the outside of the powder guiding device 17. As shown in FIG. 3, the shutter 34 reaching the open position compresses and deforms the second powder guiding member 33 formed of an elastic material. Therefore, by the friction acting between the shutter 34 and the second powder guiding member 33, the shutter 34 is held at its open position.

Of the first powder guiding member 32 and the second powder guiding member 33 separated from each other as shown in FIG. 5, the first powder guiding member 32 is moved in an approximately horizontal direction indicated by the arrow G to bring the first powder guiding member 32 and the second powder guiding member 33 to the powder guiding position shown in FIGS. 3 and 4. Also at this time, an operation similar to that explained above can be achieved.

Here, when the first powder guiding member 32 and the second powder guiding member 33 occupy the powder guiding position shown in FIG. 3, since the second powder guiding member 33 is formed of an elastic material, such as sponge, the second powder guiding member 33 can be elastically deformed to make a press-contact with the shutter 34 and the first powder guiding member 32. Therefore, air containing toner can be prevented from flowing to the outside from a gap between the first powder guiding member 32 and the second powder guiding member 33. In this manner, the second powder guiding member 33 in this example serves as a sealing member that prevents the toner conveyed to the waste toner container 28 from flowing to the outside.

As explained above, when the first powder guiding member 32 and the second powder guiding member 33 relatively move to the powder guiding position, the second powder guiding member 33 pushes the shutter 34 occupying the close position for movement to bring the shutter 34 to the open position. Also, the form of the shutter 34 and the position of its rotation pivot are set so that the rear end 49 of the upper surface 50 of the open/close plate in the shutter-moving direction is positioned inside of the upper opening 36 of the second powder guiding member 33 when the shutter 34 occupies the open position and the first powder guiding member 32 and the second powder guiding member 33 occupy the powder guiding position.

The second powder guiding member 33 shown in FIG. 3 as well as the waste toner container 28 is moved in the direction indicated by the arrow D or the first powder guiding member 32 as well as the intermediate transfer unit 19 shown in FIG. 1 is moved in the direction indicated by the arrow F, an operation reverse to that explained above is performed, thereby causing the first powder guiding member 32 and the second powder guiding member 33 to be separated from each other shown in FIG. 5. At this time, the lower opening 35 of the first powder guiding member 32 is closed by the open/close plate 40 of the shutter 34 as explained above.

Also, in the powder guiding device 17 of this example, as shown in FIGS. 3 and 4, when the shutter 34 moves to the open position, a stopper 53 is provided so as to position the shutter 34 at its open position. The stopper 53 is formed of a plate-shaped member integrally formed with the wall portion 51 of the first powder guiding member 32. This stopper can be provided to a member other than the first powder guiding member 32, for example, a frame of the image forming apparatus body.

As explained above, when the second powder guiding member 33 is moved in the direction indicated by the arrow E in FIG. 5 to rotate the shutter 34 in the direction indicated by the arrow I, the shutter 34 first reaches the open position shown in FIG. 3. At this time, the shutter 34 abuts on the stopper 53 and stops at its open position. Then, the second powder guiding member 33 moves for a subtle distance in the direction indicated by the arrow E to reach the final position shown in FIG. 3. At this time, the shutter 34 reliably stops at its open position by the stopper 53. Therefore, the portion 48 of the shutter 34 can go over the front end 47 of the second powder guiding member 33 formed of an elastic material as reliably elastically deforming the front end 47. Alternatively, the configuration can be such that the second powder guiding member 33 reaches the final position shown in FIG. 3 simultaneously when the shutter 34 stops so as to be positioned at the open position by the stopper 53. Also in this case, the portion 48 of the shutter 34 can go over the front end 47 of the second powder guiding member 33. In this manner, when the portion 48 of the shutter 34 goes over the front end 47 of the second powder guiding member 33, a shock is provided to the shutter 34. With this, the toner scraped by the lower end face 52 of the wall portion 51 of the first powder guiding member 32 efficiently falls down to the inside of the second powder guiding member 33.

As explained above, the powder guiding device 17 of this example is provided with the stopper that positions the shutter 34 at its open position when the shutter 34 moves to the open position. The stopper 53 is disposed so as to position the shutter 34 reaching the open position simultaneously or immediately before the first powder guiding member 32 and the second powder guiding member 33 making a relative movement to the powder guiding position reach the powder guiding position.

Meanwhile, when the waste toner container 28 is pressed into the image forming apparatus body 4 in a manner indicated by the arrow E in FIG. 2 so that the waste toner container 28 is set at a predetermined position in the image forming apparatus body, a shock may be added to the waste toner container 28, there increasing the pressure inside the container. In such a state, the inner pressure of the second powder guiding member 33 is also increased, thereby generating a flow of air, as indicated by an arrow L in FIG. 3, inside of the second powder guiding member 33. With this, air containing toner may flow to the outside through a gap between the first powder guiding member 32 and the second powder guiding member 33.

To get around this problem, in the powder guiding device 17 of this example, the configuration is such that, as shown in FIG. 3, when the shutter 34 occupies the open position, a space S is formed by the pair of side plates 38 and 39 of the shutter 34 (only the side plate 38 is shown in FIG. 3), the open/close plate 40, the wall portion 51 of the first powder guiding member 32 positioned between the pair of side plates 38 and 39, and a shielding plate 54. In the depicted example, as the shielding plate 54, the stopper 53 explained above is used. As a matter of course, however, the shielding plate 54 can be formed of a member other than the stopper 53. Also, a shielding plate can be provided to a member other than the first powder guiding member 32. In this manner, although the stopper 53 and the shielding plate 54 are formed of the same member, for the purpose of explanation in Specification, this member is provided with the reference numeral 53 when it is represented as a stopper, while the member is provided with the reference numeral 54 when it is represented as a shielding plate. In the powder guiding device 17 of this example, the shielding plate 54 is integrally formed with the first powder guiding member 32, and the shielding plate 54 also serves as the stopper 53.

As shown in FIG. 3, when the shutter 34 occupies the open position, a space gap M is formed between the rear end 49 of the upper surface 50 of the open/close plate of the shutter 34 and a portion of the wall portion 51 of the first powder guiding member 32 facing the rear end 49. As explained above, when the pressure inside the second powder guiding member 33 is increased, air containing toner, which is an example of powder, passes through the space gap M to flow inside the space S as indicated an arrow N in FIG. 3. Since this space S is in an approximately sealed state, the air flowing into this space S circulates in the space S, and the toner contained in the air eventually falls down onto the upper surface 50 of the open/close plate. With this, the air containing toner can be prevented from flowing from the space gap between the first powder guiding member 32 and the second powder guiding member 33, thereby preventing the toner from flowing to the outside of the powder guiding device 17. When the pressure of the second powder guiding member 33 is increased, the space S is formed as an escape for the pressure, thereby suppressing an increase in pressure inside the second powder guiding member 33 and preventing the air containing toner from flowing from the gap between the first powder guiding member 32 and the second powder guiding member 33.

Meanwhile, if the space gap M shown in FIG. 3 is too large, when the pressure inside the second powder guiding member 33 is increased, a large amount of air containing toner flows inside the space S through the space gap M. With such a state, a large amount of toner will be attached onto the upper surface 50 of the open/close plate of the shutter 34. Thus, when the shutter 34 is closed, the toner may fly to the outside of the powder guiding device 17.

Figure 6:
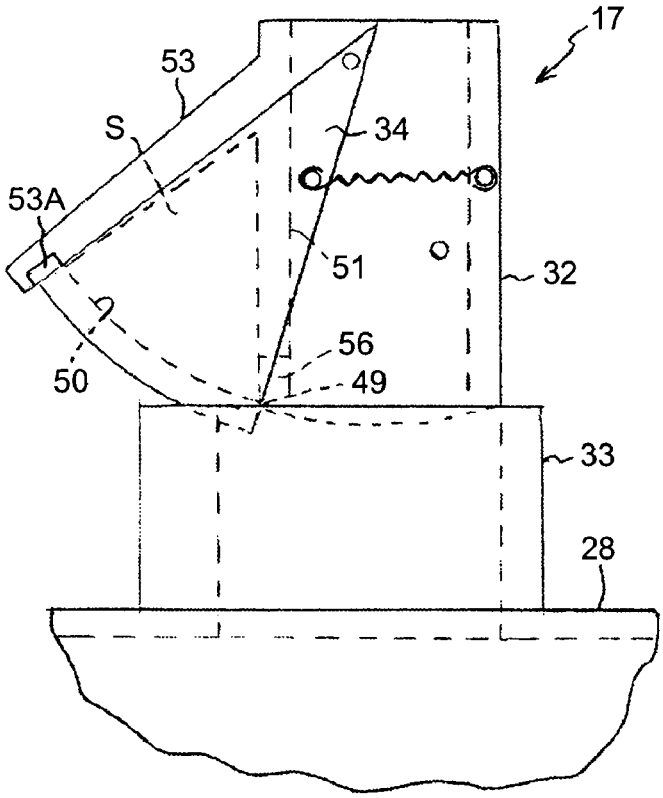
FIG. 6 is an explanatory drawing similar to FIG. 3, depicting another example of the powder guiding device.

To get around this problem, in the powder guiding device 17 shown in FIG. 6, the configuration is such that a portion 56 of the wall portion 51 of the first powder guiding member 32 facing the rear end 49 of the upper surface 50 of the open/close plate of the shutter 34 when the shutter 34 occupies the open position is formed of an elastic material, and when the pressure inside the second powder guiding member 33 is increased, the portion 56 of the wall portion 51 formed of an elastic material is elastically deformed by a wind pressure to form the space gap M (FIG. 3). That is, the portion 56 of the wall portion 51 is formed of, for example, a soft foam, such as sponge, or soft lubber. According to this configuration, when the pressure inside the second powder guiding member 33 is not particularly increased, the space gap M shown in FIG. 3 is not formed. When the pressure inside the second powder guiding member 33 is significantly increased, the space gap M is formed according to the wind pressure. Therefore, the situation can be prevented such that an appropriate amount of air flows to the inside of the space S and the air containing toner flows from the gap between the first powder guiding member 32 and the second powder guiding member 33. Also, excessive toner can be prevented from falling down to the upper surface 50 of the open/close plate.

Meanwhile, as shown in FIG. 6, when the shutter 34 occupies the open position, the shutter 34 abuts on a portion provided with a reference numeral 53A of the stopper 53. In this manner, when the portion of the stopper 53 on which the shutter 34 abuts is referred to as an abutting portion 53A, at least the abutting portion 53A of the stopper 53 is preferably formed of an elastic material. In the example shown in FIG. 6, the abutting portion 53A is formed of, for example, a soft foam, such as sponge, or a soft rubber. According to such a configuration, a shock occurring when the shutter 34 rotates to the open position shown in FIG. 6 to collide against the stopper 53 can be mitigated. Also, the sealing performance of the space S can be increased. Other configuration of the powder guiding device 17 shown in FIG. 6 is not different from that shown in FIGS. 1 to 5.

Furthermore, as explained with reference to FIG. 3, when the second powder guiding member 33 moves to the final position shown in FIG. 3 after the shutter 34 rotates and stops at the open position, the portion 48 of the shutter 34 goes over the front end 47 of the second powder guiding member 33 as elastically deforming the front end 47. At this time, if the portion 48 of the shutter 34 has a corner portion 57, when the corner portion 57 goes over the front end 47 of the second powder guiding member 33, a large external force is applied to the front end 47, resulting in a potential early deterioration of the second powder guiding member 33 formed of an elastic material.

Figure 7:
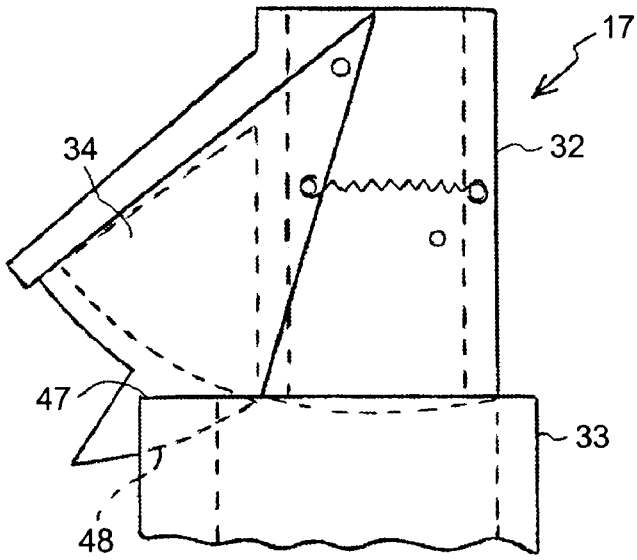
FIG. 7 is an explanatory drawing similar to FIG. 3, depicting still another example of the powder guiding device.

To get around this problem, in the powder guiding device 17 shown in FIG. 7, the portion 48 of the shutter 34 abutting on the front end 47 of the second powder guiding member 33 when the first powder guiding member 32 and the second powder guiding member 33 make a relative movement to the powder guiding position is formed in a sheet form. Thus, when the portion 48 of the shutter 34 reaching the open position makes a press-contact with the front end 47 of the second powder guiding member 33 moving toward the final position shown in FIG. 7, the pressure per unit area applied to the front end 47 can be decreased, thereby preventing the inconvenience of an early deterioration of the second powder guiding member 33.

Figure 8:
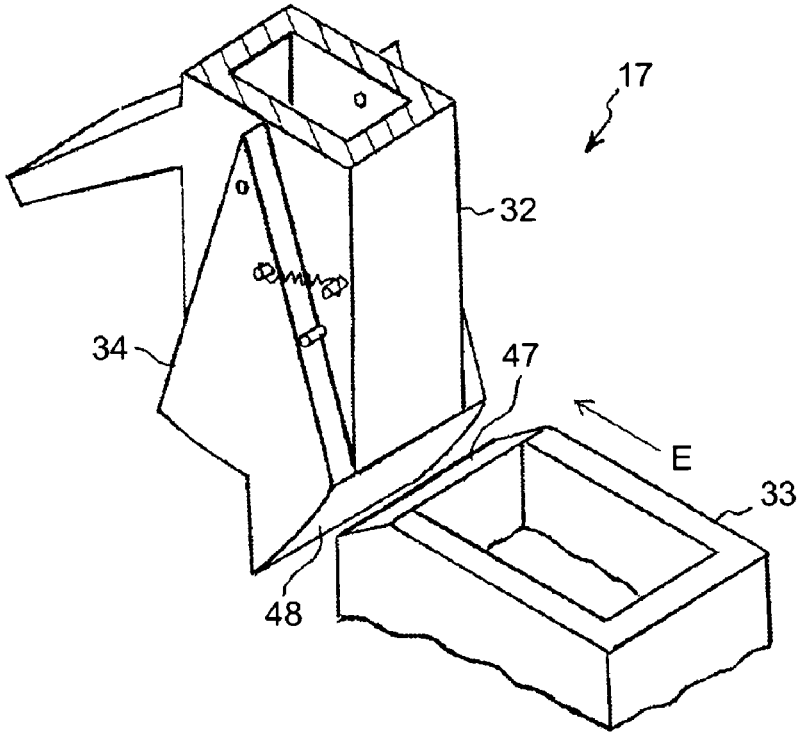
FIG. 8 is an external perspective view depicting still another example of the powder guiding device.

Similarly, as indicated by an arrow E in FIG. 8, a portion (the front end 47) of the second powder guiding member 33 abutting on the shutter 34 when the first powder guiding member 32 and the second powder guiding member 33 make a relative movement to the powder guiding position is formed in a sheet form. Also with this, the pressure per unit area applied by the portion 48 of the shutter 34 to the front end 47 of the second powder guiding member 33 can be decreased, thereby preventing the inconvenience of an early deterioration of the second powder guiding member 33. As shown in FIG. 8, if the portion 48 of the shutter 34 and the front end 47 of the second powder guiding member 33 are each formed in a sheet form, an early deterioration of the second powder guiding member 33 can more effectively prevented. Also, a shock occurring when the front end 47 and the portion 48 of the shutter 34 collide with each other can be decreased.

Figure 9:
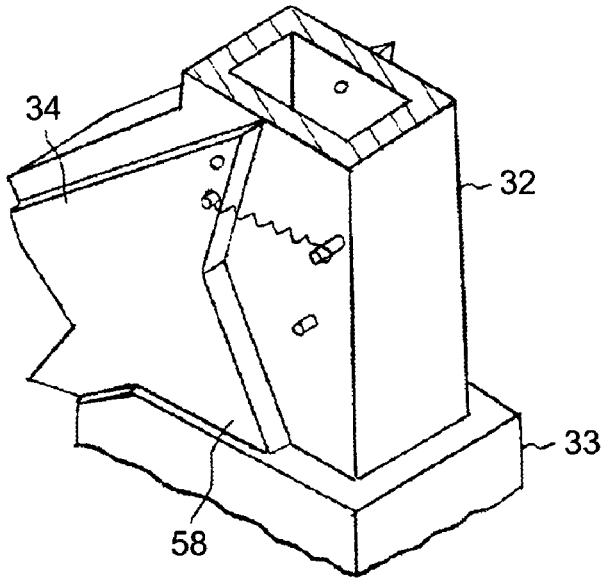
FIG. 9 is an external perspective view depicting still another example of the powder guiding device.

Still further, as shown in FIG. 9, a sealing portion 58 is provided the shutter 34 that seals at least part of a subtle gap formed between the first powder guiding member 32 and the second powder guiding member 33 when the first powder guiding member 32 and the second powder guiding member 33 occupy the powder guiding position. With this, air containing toner can be more reliably prevented from leaking from the gap between the first powder guiding member 32 and the second powder guiding member 33

Other portions of the powder guiding device 17 shown in FIGS. 7 to 9 can be configured in a manner similar to that for configuring the portions shown in FIGS. 1 to 6.

In the foregoing, while the powder guiding device 17 has been explained that is provided between the belt cleaning device 11 that removes residual transfer toner attached to the image carrier formed of the intermediate transfer member 21 after toner image transfer and the waste toner container 28 having accommodated therein the residual transfer toner removed by that cleaning device 11, the present invention can also be applied to another powder guiding device as appropriate. For example, the present invention can be applied without problems to a powder guiding device provided between a cleaning device that removes residual transfer toner on an image carrier formed of a photosensitive member and a waste toner container having that toner accommodated therein.

According to the present invention, when a shutter occupies an open position and the first powder guiding member and the second powder guiding member occupy a powder guiding position, a rear end of an upper surface of an open/close plate in a moving direction is positioned inside of an upper opening of the second powder guiding member. With this, a problem in which powder attached to the shutter will fly to the outside of the powder guiding device can be effectively suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A powder guiding device comprising:

a first powder guiding member and a second powder guiding member capable of being separated from each other through a relative movement in an approximately horizontal direction from a powder guiding position where a lower opening of the first powder guiding member matches with an upper opening of the second powder guiding member to allow powder to be guided and making a relative movement to the powder guiding position; and a shutter that takes a close position allowing the lower opening of the first powder guiding member to be closed when the first powder guiding member and the second powder guiding member are separated from each other and takes an open position allowing the lower opening of the first powder guiding member is opened when the first powder guiding member and the second powder guiding member occupy the powder guiding position, wherein a shape and a position of a rotational pivot of the shutter are set such that the shutter includes a pair of side plates facing each other and an open/close plate coupled to a lower portion of the pair of side plates and is rotatably supported, with an upper portion of the pair of side plates as the rotational pivot, between the close position allowing the open/close plate to close the lower opening of the first powder guiding member and the open position allowing the open/close plate to be retracted from the lower opening of the first powder guiding member, the second powder guiding member is formed of an elastic material, the shutter is formed of a material with a stiffness higher than a material of the second powder guiding member, the second powder guiding member pushes the shutter occupying the close position to bring the shutter to the open position when the first powder guiding member and the second powder guiding member make a relative movement to the powder guiding position, and a rear end of an upper surface of the open/close plate in a shutter-moving direction is positioned inside of the upper opening of the second powder guiding member when the shutter occupies the open position and the first powder guiding member and the second powder guiding member occupy the powder guiding position.

2. The powder guiding device according to claim 1, further comprising a stopper that positions the shutter at the open position when the shutter moves to the open position, wherein the stopper is disposed so as to position the shutter reaching the open position simultaneously or immediately before the first powder guiding member and the second powder guiding member making a relative movement to the powder guiding position reach the powder guiding position.

3. The powder guiding device according to claim 1, wherein when the shutter occupies the open position, a space is formed by the pair of side plates of the shutter, the open/close plate, a wall portion of the first powder guiding member positioned between the pair of side plates, and a shielding plate, and when a pressure inside the second powder guiding member is increased, air containing powder is allowed to flow into the space through a space gap between the rear end of the upper surface of the open/close plate of the shutter and a portion of the wall portion of the first powder guiding member facing the rear end.

4. The powder guiding device according to claim 3, wherein the shielding plate is integrally formed with the first guiding member, and the shielding plate serves as the stopper.

5. The powder guiding device according to claim 3, wherein the portion of the wall portion of the first powder guiding member facing the rear end of the upper surface of the open/close plate of the shutter when the shutter occupies the open position is formed of an elastic material and, when the pressure inside the second powder guiding member is increased, the portion of the wall portion formed of the elastic material is elastically deformed by a wind pressure to form the space gap.

6. The powder guiding device according to claim 2, wherein the stopper on which the shutter abuts when the shutter occupies the open position is taken as an abutting portion, and at least the abutting portion of the stopper is formed of an elastic material.

7. The powder guiding device according to claim 3, wherein the stopper on which the shutter abuts when the shutter occupies the open position is taken as an abutting portion, and at least the abutting portion of the stopper is formed of an elastic material.

8. The powder guiding device according to claim 1, wherein a portion of the shutter making a press-contact with the second powder guiding member when the first powder guiding member and the second powder guiding member make a relative movement to the powder guiding position is formed in a sheet shape.

9. The powder guiding device according to claim 1, wherein a portion of the second powder guiding member making a press-contact with the shutter when the first powder guiding member and the second powder guiding member make a relative movement to the powder guiding position is formed in a sheet shape.

10. The powder guiding device according to claim 1, wherein a sealing portion is provided to the shutter, the sealing portion sealing at least part of a gap between the first powder guiding member and the second powder guiding member when the first powder guiding member and the second powder guiding member occupy the powder guiding position.

11. The powder guiding device according to claim 1, wherein the powder guiding device is provided between a cleaning device that removes residual transfer toner attached onto an image carrier after toner image transfer and a waste toner container having accommodated therein the residual transfer toner removed by the cleaning device.

12. An image forming apparatus comprising a powder guiding device that includes a first powder guiding member and a second powder guiding member capable of being separated from each other through a relative movement in an approximately horizontal direction from a powder guiding position where a lower opening of the first powder guiding member matches with an upper opening of the second powder guiding member to allow powder to be guided and making a relative movement to the powder guiding position, and a shutter that takes a close position allowing the lower opening of the first powder guiding member to be closed when the first powder guiding member and the second powder guiding member are separated from each other and takes an open position allowing the lower opening of the first powder guiding member is opened when the first powder guiding member and the second powder guiding member occupy the powder guiding position, wherein a shape and a position of a rotational pivot of the shutter are set such that the shutter includes a pair of side plates facing each other and an open/close plate coupled to a lower portion of the pair of side plates and is rotatably supported, with an upper portion of the pair of side plates as the rotational pivot, between the close position allowing the open/close plate to close the lower opening of the first powder guiding member and the open position allowing the open/close plate to be retracted from the lower opening of the first powder guiding member, the second powder guiding member is formed of an elastic material, the shutter is formed of a material with a stiffness higher than a material of the second powder guiding member, the second powder guiding member pushes the shutter occupying the close position to bring the shutter to the open position when the first powder guiding member and the second powder guiding member make a relative movement to the powder guiding position, and a rear end of an upper surface of the open/close plate in a shutter-moving direction is positioned inside of the upper opening of the second powder guiding member when the shutter occupies the open position and the first powder guiding member and the second powder guiding member occupy the powder guiding position.

* * * * *